US009750302B2

(12) United States Patent
Hanft

(10) Patent No.: US 9,750,302 B2
(45) Date of Patent: Sep. 5, 2017

(54) ORTHOTIC INSERT DEVICE

(71) Applicant: Jason R. Hanft, South Miami, FL (US)

(72) Inventor: Jason R. Hanft, South Miami, FL (US)

(73) Assignee: Heel-It, LLC, South Miami, FL (US)

( * ) Notice: Subject to any disclaimer, the term of this patent is extended or adjusted under 35 U.S.C. 154(b) by 416 days.

(21) Appl. No.: 13/965,672

(22) Filed: Aug. 13, 2013

(65) Prior Publication Data

US 2015/0047221 A1 Feb. 19, 2015

(51) Int. Cl.

| | |
|---|---|
| ***A43B 13/38*** | (2006.01) |
| ***A43B 7/14*** | (2006.01) |
| ***A43B 17/00*** | (2006.01) |
| ***A43B 17/02*** | (2006.01) |

(52) U.S. Cl.

CPC ..... *A43B 7/141* (2013.01); *A43B 17/006* (2013.01); *A43B 17/023* (2013.01)

(58) Field of Classification Search

CPC ..... A43B 7/141; A43B 7/142; A43B 7/144; A43B 7/14; A43B 17/006; A43B 17/023

USPC ..... 36/28, 43

See application file for complete search history.

(56) References Cited

U.S. PATENT DOCUMENTS 1,244,027 A * 10/1917 Calvey ..... A43B 7/142 36/173
1,690,964 A * 11/1928 Balaskas ..... A43B 7/142 36/164
1,867,431 A * 7/1932 Wood ..... A43B 7/1445 33/1 C
2,081,474 A * 5/1937 Burns ..... A43B 7/06 36/174
2,307,416 A * 1/1943 Margolin ..... A43B 7/223 36/147
2,924,849 A * 2/1960 Buchman ..... A43B 7/14 12/146 M (Continued)

FOREIGN PATENT DOCUMENTS

| | | |
|---|---|---|
| JP | 2008534113 | 8/2008 |
| KR | 1020110066334 | 6/2011 |

OTHER PUBLICATIONS

Polyurethane Materials Technical Data Chart. C.U.E. Inc. Web. Aug. 31, 2015. Retrieved from May 14, 2008. http://www.cue-inc.com/technical-data-charts.html.*

(Continued)

*Primary Examiner* — Nathan Durham
*Assistant Examiner* — Anne Kozak
(74) *Attorney, Agent, or Firm* — Offit Kurman, P.A.; Richard P. Gilly

(57) ABSTRACT

An orthotic insert device has a first portion generally underlying the plantar surface of the heel fat pad of the calcaneus of a wearer's foot when the insert is placed in a corresponding shoe. The device has a second portion which is located and sized to generally underlie the mid-foot of the wearer. The first portion under the heel is less rigid, that is, more compressible, than the second portion underlying the mid-foot. As a result, the device not only decreases the force felt on the heel, but also acts to offload the force from the heel toward the mid-foot, especially during the impact phase of a person's gait. By off-loading the heel and transferring weight to the mid-foot, force otherwise felt in the region of the calcaneus is dissipated over a much larger surface area, including the mid-foot.

20 Claims, 3 Drawing Sheets

(56) References Cited

U.S. PATENT DOCUMENTS 3,095,658 A * 7/1963 Midgley ..... A43B 13/141 12/146 B
3,306,300 A * 2/1967 Van Kleef ..... A43B 7/141 36/178
3,530,489 A * 9/1970 Appleton ..... A43B 7/28 36/44
3,638,336 A * 2/1972 Silverman ..... A43B 21/32 36/44
3,730,169 A * 5/1973 Fiber ..... A43B 7/142 36/154
3,828,792 A * 8/1974 Valenta ..... A43B 7/14 36/178
4,124,946 A * 11/1978 Tomlin ..... A43B 7/142 36/11.5
4,232,457 A * 11/1980 Mosher ..... A43B 7/141 36/154
4,316,335 A * 2/1982 Giese ..... A43B 5/00 36/129
4,346,525 A * 8/1982 Larsen ..... A43B 7/144 36/145
4,435,910 A * 3/1984 Marc ..... A43B 5/06 36/173
4,510,700 A * 4/1985 Brown ..... A43B 7/142 36/154
4,513,518 A * 4/1985 Jalbert ..... A43B 7/142 36/178
4,517,981 A * 5/1985 Santopietro ..... A43B 7/14 36/140
4,530,173 A * 7/1985 Jesinsky, Jr. ..... A43B 21/32 36/173
4,580,356 A * 4/1986 David ..... A43B 17/14 36/43
4,586,273 A * 5/1986 Chapnick ..... A43B 7/142 36/154
4,627,178 A * 12/1986 Sullivan ..... B29D 35/122 12/146 BR
4,648,923 A * 3/1987 Chapnick ..... A43B 7/142 156/221
4,669,142 A * 6/1987 Meyer ..... A43B 7/28 12/142 N
4,686,993 A * 8/1987 Grumbine ..... A43B 7/141 36/140
4,694,589 A * 9/1987 Sullivan ..... B29D 35/122 12/146 BR
4,702,255 A * 10/1987 Schenkl ..... A43B 7/141 36/145
4,747,410 A 5/1988 Cohen
4,782,605 A * 11/1988 Chapnick ..... A43B 7/142 156/221
4,791,736 A * 12/1988 Phillips ..... A43B 7/28 12/142 P
4,800,657 A 1/1989 Brown
D302,624 S * 8/1989 Thompson ..... D2/961
4,868,945 A * 9/1989 DeBettignies ..... A43B 13/14 12/142 N
4,930,232 A * 6/1990 Engle ..... A43B 13/12 36/44
4,962,593 A * 10/1990 Brown ..... A43B 7/141 36/173
4,979,318 A * 12/1990 Cohen ..... A43B 7/141 36/144
5,036,851 A * 8/1991 Cohen ..... A43B 7/1415 36/161
5,069,212 A * 12/1991 Cohen ..... A43B 7/14 36/174
5,138,774 A * 8/1992 Sarkozi ..... A43B 7/14 36/159
5,146,698 A * 9/1992 Tilles ..... A43B 13/40 36/178
5,187,885 A * 2/1993 Murphy ..... A43B 5/001 36/127
5,282,326 A * 2/1994 Schroer, Jr. ..... A43B 17/023 36/145
5,282,328 A * 2/1994 Peterson ..... A43D 1/022 36/140
5,327,664 A * 7/1994 Rothbart ..... A43B 7/14 36/174
5,572,805 A * 11/1996 Giese ..... A43B 13/12 36/103
5,611,153 A * 3/1997 Fisher ..... A43B 7/14 36/173
D391,749 S * 3/1998 Fisher ..... D2/961
5,741,568 A * 4/1998 Rudy ..... A43B 7/141 36/28
D396,138 S * 7/1998 Roy ..... D2/961
5,842,294 A * 12/1998 Fabricant ..... A43B 7/14 36/127
5,933,984 A * 8/1999 Carlson ..... A43B 17/14 36/127
6,000,147 A * 12/1999 Kellerman ..... A43B 7/142 36/160
6,038,793 A * 3/2000 Kendall ..... A43B 7/14 36/173
6,061,929 A * 5/2000 Ritter ..... A43B 3/0052 36/107
6,233,847 B1 * 5/2001 Brown ..... A43B 7/142 36/174
6,237,251 B1 * 5/2001 Litchfield ..... A43B 1/0072 36/114
6,282,816 B1 * 9/2001 Rosendahl ..... A43B 7/141 36/174
6,315,786 B1 * 11/2001 Smuckler ..... A43B 7/14 36/145
6,460,275 B1 * 10/2002 Bennett ..... A61F 5/14 36/144
6,523,206 B2 * 2/2003 Royall ..... A43B 3/128 12/142 N
6,708,424 B1 * 3/2004 Ellis, III ..... A43B 5/00 36/114
6,851,204 B2 * 2/2005 Aveni ..... A43B 7/1465 36/114
6,871,422 B2 * 3/2005 Blackburn ..... A43B 17/02 36/107
6,939,502 B2 * 9/2005 Lyden ..... A43B 3/0063 12/146 B
D520,221 S * 5/2006 Bray, Jr. ..... D2/961
7,458,173 B2 * 12/2008 Kielt ..... A43B 3/0063 36/145
7,581,336 B2 * 9/2009 Segalin ..... A43B 7/141 36/166
7,625,349 B2 * 12/2009 Bleau ..... A43B 7/141 602/23
7,900,380 B2 * 3/2011 Rich ..... A43B 7/142 36/154
8,333,023 B2 * 12/2012 Losio ..... A43B 7/141 12/142 R
8,479,413 B2 * 7/2013 Avent ..... A43B 7/14 36/108
D694,998 S * 12/2013 Dolce ..... D2/947
D694,999 S * 12/2013 Feldman ..... D2/961
8,800,168 B1 * 8/2014 Propet ..... A43B 7/141 36/173
8,914,996 B2 * 12/2014 Liu ..... A43B 1/0045 36/140
8,966,788 B2 * 3/2015 Barak ..... A61F 5/14 36/173
2002/0007569 A1 * 1/2002 Crane ..... A43B 3/26 36/44
2002/0050080 A1 * 5/2002 Vasyli ..... A43B 7/141 36/145
2003/0005599 A1 * 1/2003 Panaccione ..... A43B 13/383 36/43
2003/0009915 A1 * 1/2003 Bacon ..... A43B 7/142 36/44
2003/0061735 A1 * 4/2003 Polifroni ..... A43B 7/141 36/44

(56) References Cited

U.S. PATENT DOCUMENTS

2003/0061739 A1* 4/2003 Polifroni ..... A43B 7/141 36/91
2003/0070321 A1* 4/2003 Davis ..... A43B 7/144 36/43
2004/0250450 A1* 12/2004 Snell ..... A43B 7/00 36/45
2005/0108899 A1* 5/2005 Kielt ..... A43B 3/0063 36/71
2005/0217142 A1* 10/2005 Ellis ..... A43B 3/0005 36/25 R
2006/0242860 A1* 11/2006 Canvin ..... A43B 7/142 36/83
2006/0248749 A1* 11/2006 Ellis ..... A43B 3/0005 36/28
2007/0277400 A1* 12/2007 Nguyen ..... A43B 7/142 36/145
2007/0289163 A1 12/2007 Weiss
2007/0289170 A1* 12/2007 Avent ..... A61F 5/14 36/166
2008/0072461 A1* 3/2008 Howlett ..... A61F 5/14 36/145
2008/0086916 A1* 4/2008 Ellis ..... A43B 7/1425 36/103
2009/0139111 A1* 6/2009 Joseph ..... A43B 21/26 36/92
2009/0183388 A1* 7/2009 Miller ..... A43B 7/141 36/43
2009/0307927 A1* 12/2009 Manolian ..... A43B 3/30 36/43
2010/0000122 A1* 1/2010 Andrews ..... A43B 17/003 36/43
2011/0009982 A1* 1/2011 King ..... A43B 7/1425 623/53
2011/0023324 A1* 2/2011 Dananberg ..... A43B 7/1435 36/10
2011/0219642 A1* 9/2011 Sulak ..... A43B 7/141 36/44
2011/0258879 A1* 10/2011 Dananberg ..... A43B 7/141 36/91
2011/0277348 A1* 11/2011 Fox ..... A43B 7/142 36/43
2012/0159814 A1* 6/2012 Smith ..... A43B 1/0081 36/92
2012/0324758 A1* 12/2012 Tang ..... A43B 13/12 36/28
2013/0081306 A1* 4/2013 Park ..... A43B 7/1425 36/43
2013/0232814 A1* 9/2013 Blum ..... A43B 7/142 36/43
2013/0291397 A1* 11/2013 Barteet ..... A43B 1/0054 36/11.5
2013/0291399 A1* 11/2013 Fonte ..... A43B 17/006 36/44
2014/0007456 A1* 1/2014 Tadin ..... A43B 13/38 36/43
2014/0053430 A1* 2/2014 Supple ..... A43B 7/141 36/92
2014/0059887 A1* 3/2014 Lawlor ..... A43B 7/14 36/83
2014/0059895 A1* 3/2014 Arciuolo ..... A43B 7/00 36/173
2014/0109439 A1* 4/2014 Barr ..... A43B 7/144 36/43
2014/0245631 A1* 9/2014 Joseph ..... A43B 1/0027 36/44
2014/0250722 A1* 9/2014 Lin ..... A43B 7/142 36/44
2014/0259755 A1* 9/2014 Tsai ..... A43B 7/1415 36/43
2014/0259757 A1* 9/2014 Tsai ..... A43B 7/144 36/44
2014/0366399 A1* 12/2014 Wakeland ..... A43B 13/386 36/44
2015/0000158 A1* 1/2015 Wang ..... A43B 7/142 36/43
2015/0143713 A1* 5/2015 Cheng ..... A43B 7/141 36/43

OTHER PUBLICATIONS

Patent Cooperation Treaty, "International Search Report and Written Opinion" Korean Searching Authority, document of 11 pages, dated Aug. 20, 2014.
Gkionaki, Angeliki, "Supplemental European Search Report," dated Feb. 23, 2017, 7 pages.

* cited by examiner

ORTHOTIC INSERT DEVICE

FIELD

This disclosure relates to orthotic devices and, more particularly, to an orthotic insert device.

BACKGROUND

There exists a variety of orthotic inserts, ranging from custom orthotic inserts prepared by medical practitioners to off-the-shelf varieties, such as foot pads, cushioning insoles and the like. Certain of these inserts may be geared more toward improving arch support, so that the arch undergoes fewer traumas or stress, especially during running or other physical activities. Other shoe inserts and orthotics may address long-term general comfort issues and focus on improving the cushioning of the associated shoe or athletic footwear, again, with the goal of reducing foot fatigue which may develop when the wearer is "on their feet" for extended periods of time. Still other inserts may focus on returning energy during running or walking, by providing a springiness or spring force, generally directed through the user's heel, with the thought that such energy return would improve speed or athletic performance. Prior art inserts often do not adequately factor in foot or heel anatomy or the associated dynamics.

The orthotic inserts of the current art suffer from various drawbacks and disadvantages. Accordingly, there is a need for an improved orthotic insert device to address disorders of the heel and hind-foot and their associated discomforts.

SUMMARY

In one implementation, an orthotic insert is adapting to alleviate heel pain and includes two or more portions. The first portion is located and sized to underlie and elevate the heel, and has a corresponding first compression load deflection. The second portion is anterior to the first portion, and is located and sized to underlie the mid-foot. The second portion has a compression load deflection value greater than that of the first portion, which, in practical terms, means that the second portion deflects less readily than the first portion under comparable force. In this way, the first portion is less rigid than the second portion, and the insert thereby offloads vertical force from the heel toward the mid-foot during a person's gait.

In another variation, the first portion of the orthotic insert is configured to extend from the heel counter of a corresponding shoe in which the insert may be received, to a zone underlying the plantar surface of the foot just distal to the insertion of the plantar fascia on the medial tubercle of the calcaneus. The second portion extends from a zone underlying the plantar surface just distal of the insertion of the plantar fascia on the medial tubercle of the calcaneus, extending medially and laterally, substantially underlying the calcaneal cuboid joint, and tapering distally to a location proximal to the metatarsal heads.

In still further implementations, the first portion has a compression load deflection of 400 to 1000 pounds per square inch (psi), whereas the second portion anterior to the first portion has a compression load deflection of between 600 to 1,200 psi.

In still further implementations, an orthotic insert consists essentially of two zones of material. The first zone having compression load deflection of 400 to 1000 psi and the second zone having a compression load deflection of 600 to 1,200 psi. In yet another implementation, the two zones of different compression load deflection have opposing boundaries which slope to form a third transition zone, the third transition zone having a compression load deflection between the corresponding compression load deflections of the first and second zones.

BRIEF DESCRIPTION OF THE DRAWINGS

The disclosure herein will be more readily understood with reference to the drawings, in which.

DETAILED DESCRIPTION

Figure 1:
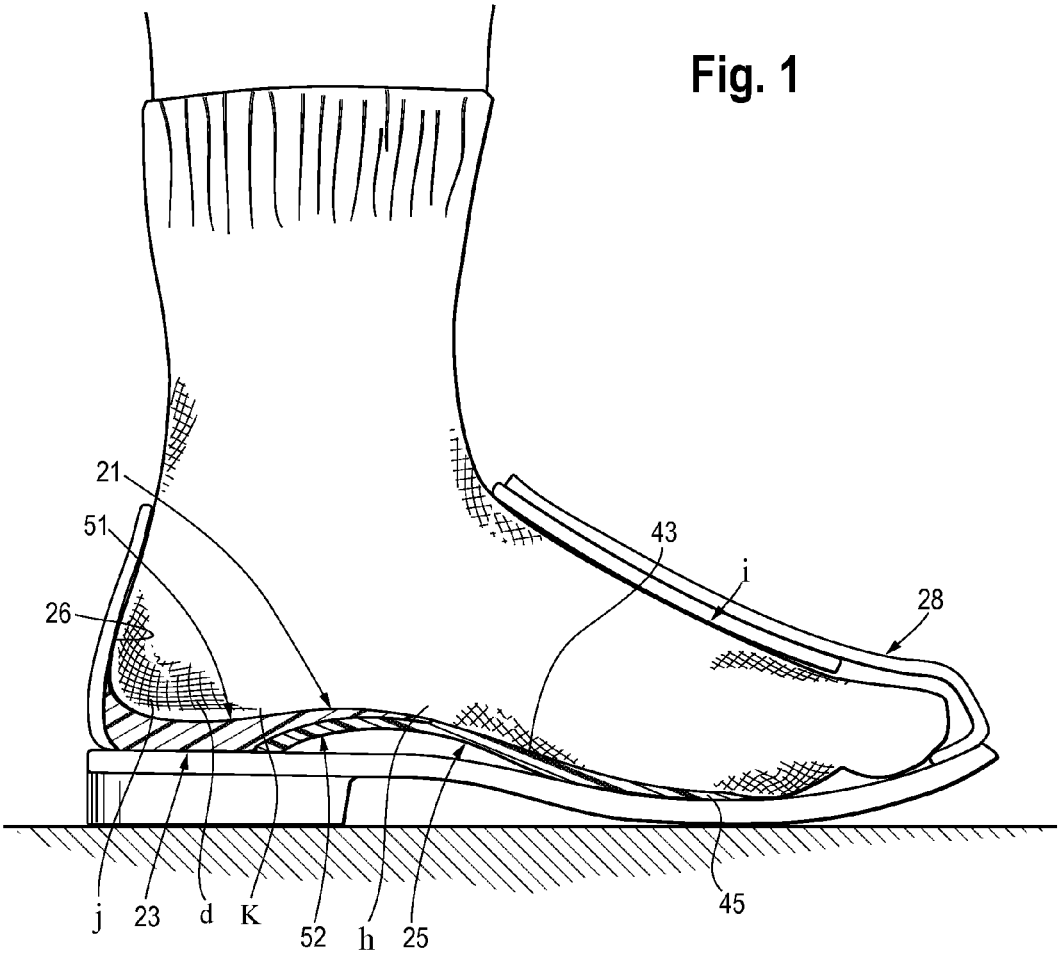
FIG. 1 is an elevational, cross-sectional view showing an orthotic insert device according to the present disclosure, which has been inserted into a wearer's shoe, the orthotic insert device underlying the wearer's foot inserted in said shoe.

Referring to the drawings, FIG. 1 shows one implementation of an orthotic insert device 21 adapted to be inserted into a wearer's shoe 28. Device 21 includes an upper or dorsal surface 51 adapted to underlie plantar surface k of the wearer's foot, and a lower plantar surface 52 which generally faces the shoe insole. Device 21 includes two portions, a first portion 23 generally underlying the plantar surface of the heel fat pad below calcaneus d, and a second portion 25 located and sized to generally underlie mid-foot h of a human foot i. First portion 23 underlying calcaneus d is less rigid, that is, more compressible, than second portion 25 underlying mid-foot h. As discussed below, the foregoing and other characteristics of this implementation of device 21 cause not only a decrease in the force felt on the heel, but also an offloading of vertical force from the heel j toward the mid-foot h, especially during the impact or propulsive phases of a person's gait. By offloading the heel and transferring weight to the mid-foot, force otherwise felt in the region of calcaneus d is dissipated over a much larger surface area, including mid-foot h.

Time and force applied to the heel area are shortened and reduced, resulting in a decrease or elimination of discomfort associated with many disorders of the heel and hind-foot. Disorders which may be advantageously treated using this implementation of device 21 include, without limitation, the following: heel pain, plantar fasciitis, heel spur, bone contusion, hematoma, heel bursitis, chronic inflammation of the heel pad, Severs disease (calcaneal apophysitis), growth plate injury, post-traumatic pain, soft tissue injury, bone loss, puncture wound, tendonitis, achilles pathology, equinus, arthritis, enthesiopathy, and limb length discrepancy.

Figure 2:
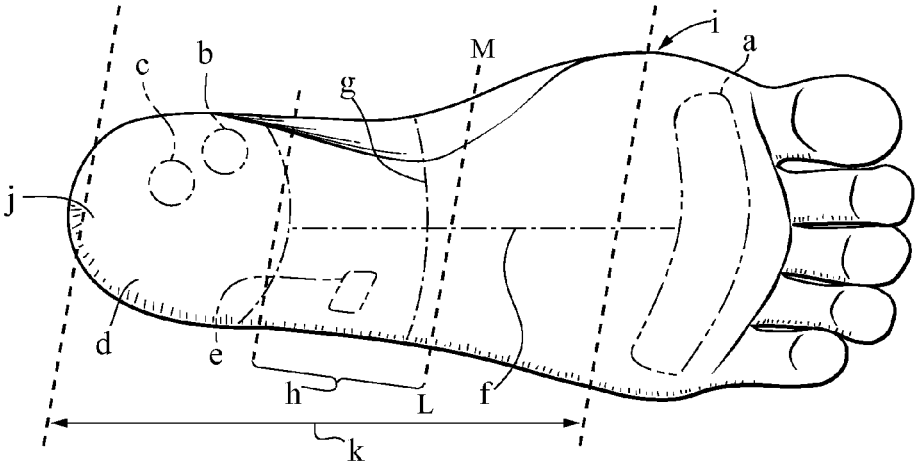
FIG. 2 is a bottom plan view of a typical wearer's foot.

Portions 23 and 25, in this implementation, are advantageously sized and located relative to certain anatomical features of the foot, illustrated in FIG. 2. In general terms, foot i includes a lower or plantar surface k, and device 21 at least partially underlies plantar surface k as shown in FIG. 1. Heel j includes calcaneus d and a heel fat pad generally disposed between calcaneus d and the corresponding plantar surface of heel j. Calcaneus d includes a medial tubercle c into which the proximal or posterior ends of plantar fascia (not shown) are inserted, such insertion region being generally shown by reference letter "b" in FIG. 2. The plantar fascia (not shown) extend from insertion region b to metatarsal heads a.

Mid-foot h extends distally or anteriorly from heel region j and includes therein the calcaneal cuboid joint, laterally, located approximately in the region indicated by e in FIG. 2, and the navicular cuneiform joint, medially (not shown). Feet are also characterized as having a corresponding longitudinal arch f and sagittal plane arch g, as shown in FIG. 2.

Referring now to FIGS. 3-6, various features of orthotic insert device 21 are shown and described with reference to each other and the anatomical features of the foot. Structurally, portion 23 has a posterior or proximal edge 24 adapted to lie adjacent or near heel counter 26 of corresponding shoe 28 (FIG. 1). Portion 23 includes an upper or dorsal surface 29 and an opposite, lower surface 31. Upper surface 29 forms a proximal or posterior portion of the overall upper surface 51 of device 21. Portion 23 is comprised of resiliently compressible material which extends from proximal edge 24 forward and ends in an anterior or forward distal surface 33. The thickness of portion 23 narrows as portion 23 extends forward or distally in the longitudinal direction, such that surface 29 slopes slightly downwardly from the horizontal in the orientation shown in FIG. 5, thereby locating surface 29 near proximal edge 24 higher relative to surface 29 at distal edge 35. Heel j (FIG. 1) is elevated by resiliently compressible portion 23.

Figure 3:
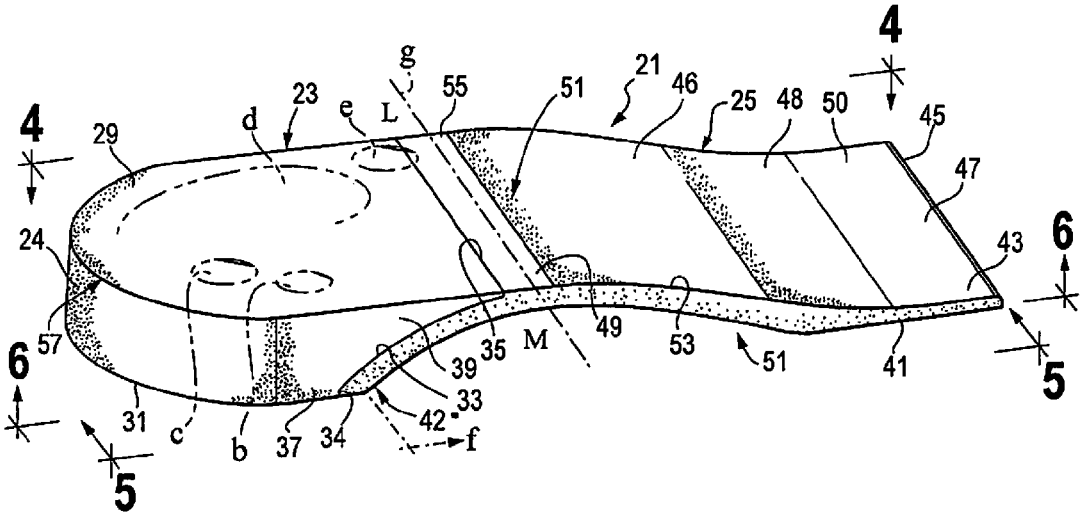
FIG. 3 is an isometric view of the orthotic insert device of FIG. 1 according to the present disclosure.
Figure 4:
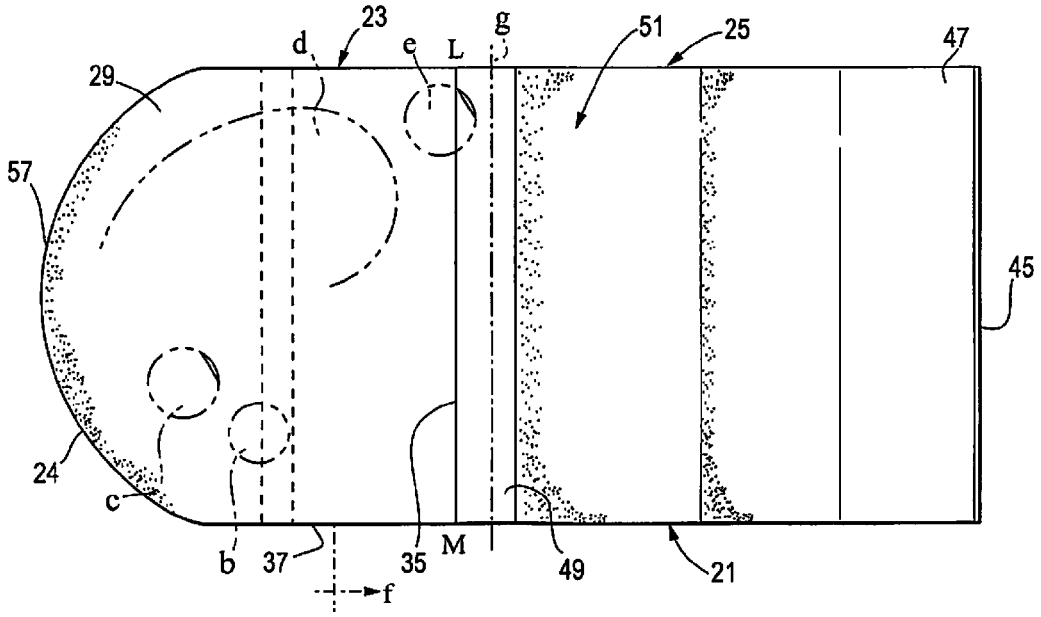
FIG. 4 is a top plan view of the orthotic insert device of FIGS. 1 and 3.
Figure 5:
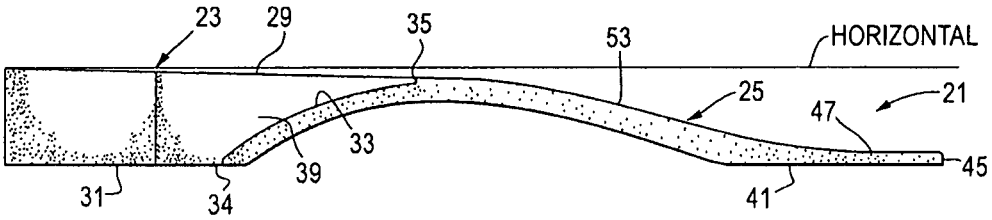
FIG. 5 is a side elevational view of the orthotic device of FIGS. 1, 3, and 4.
Figure 6:
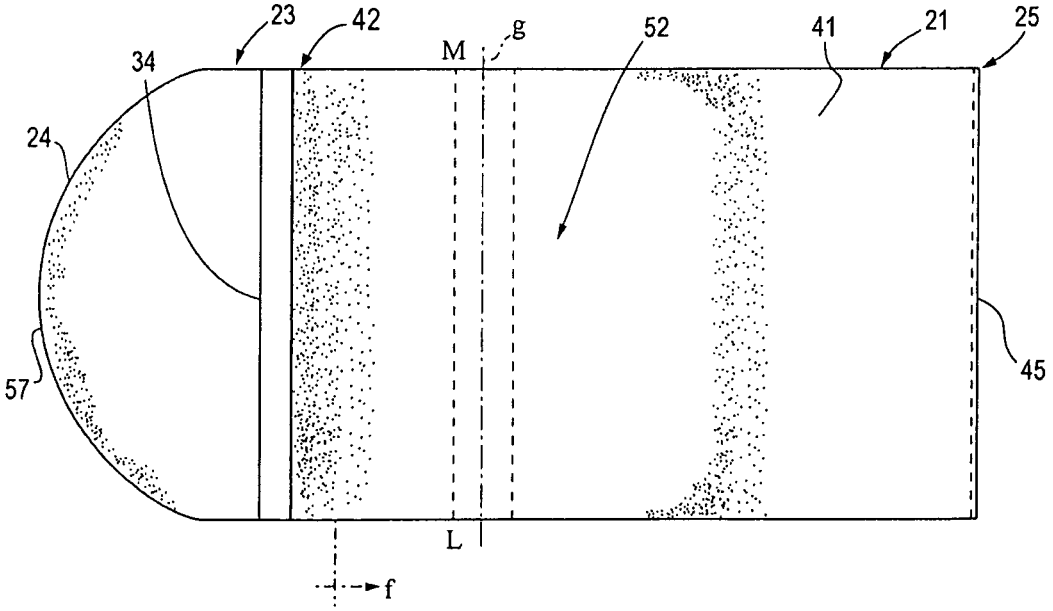
FIG. 6 is a bottom plan view of the orthotic insert device of FIGS. 1, 3 and 4, and 5.

As seen in FIGS. 3 and 4, portion 23 includes a forward or distal surface 33 which extends in an arc between lower surface 31 and upper surface 29 of portion 23. The arc begins at a location 34 at the lower surface 31, and extends to a distal edge 35 on upper surface 29. As such, the first portion 23 extends from heel counter 26 first in a generally planar fashion to a zone 37, slightly distal to the insertion point b of the plantar fascia into the medial tubercle, and then begins to taper as it extends further distally along arcuate surface 33. The tapering of first portion 23 continues to distal edge 35 at or near the calcaneal cuboid joint e and sagittal plane arch g.

Second portion 25 is generally arc-shaped in longitudinal cross-section, and has upper and lower surfaces 47, 41 (respectively), extending from a proximal edge 42 to a distal edge 45. Portion 25 has a proximal or posterior portion 39 which opposes and extends along corresponding distal surface 33 of portion 23, as seen in FIG. 3. Proximal portion 39 extends from proximal edge 42, just distal of the insertion point of the plantar fascia in the medial tubercle of the calcaneus, medially and laterally Upper surface 47 may be configured to extend in arcs or slopes, having different radii of curvature or degrees, as appropriate, as it extends longitudinally from back to front. In this implementation, upper surface 47 curves upwardly as shown in FIG. 3 from its proximal edge 42 to an apex region 49. In this way, portion 25 substantially underlies calcaneal cuboid joint e. From said apex 49, surface 47 extends distally and slopes or arcs generally downwardly, defining three regions 46, 48, and 50 on upper surface 47, each having corresponding downward slopes or arcs, terminating proximal to metatarsal heads a, where upper surface 47 terminates along with lower surface 41 to form forward edge 45. Portion 25 underlies a substantial portion of the mid-foot h, generally about 75 to 100%. Upper surface 47, from its apex 49 and forward to edge 45, forms part of upper surface 51 of insert device 21 which is designed to underlie plantar surface k of the user's foot. The posterior portion of device upper surface 51, as discussed previously, is comprised of upper surface 29 of portion 23.

Upper surface 47 of portion 25 makes substantial contact with at least a substantial portion of the bony and soft tissue structure of the foot. Second portion 25 includes a transverse plane curvature 53 adapted to make substantial contact with longitudinal plane arch f. Portion 25 likewise includes a sagittal plane curvature 55 adapted to make substantial contact with a corresponding sagittal plane arch g of the foot.

Device 21, as illustrated herein, has been designed with reference to the left foot. The same principles described herein for the left foot and left insert would apply to a device for the right foot, in mirror image. Of course, device 21 may include suitable contouring or other features, and may likewise comprise a pair of orthotic inserts for the left and right foot.

In this implementation, portions 23, 25 are formed of suitable material to have a compression load deflection value for portion 23 which is less than that of portion 25. In other words, portion 25 is more rigid than portion 23, and thereby deflects less readily than first portion 23 under comparable force. Suitable compression load deflections for portion 23 may be selected from the range of 400 and 1,000 psi, and a suitable compression load deflection value for portion 25 may be selected to be greater than that of portion 23, and in the range of 600 to 1,200 psi, whereby the second portion is more rigid than the first portion.

In one preferred implementation, the operative elements of first portion 23 may be formed substantially of foam or rubber, whereas those of second portion 25 may be substantially a plastic or polymeric material, so that portion 25 is generally more rigid or resilient than portion 23. In other implementations, portions 23, 25 may be formed of the same materials processed to achieve the differing ranges of compression load deflection set out herein, as well as one or more foam or plastic materials, mixed, layered or otherwise blended.

In terms of durometer of portions 23, 25, using the 00 durometer measurement scale described in ASTM D2240, first portion 23 may have a durometer of about 70 to about 80, and second portion 25 has a durometer of about 90 to about 100, or alternatively, may have a still higher durometer. In relative terms, the durometer of portion 23 may be less than that associated with portion 25 by about 10 to about 30, or, alternatively, a still greater relative difference in durometer values.

The material or materials forming portions 23, 25 may include resiliently compressible materials. In one possible implementation, material or materials are formed from a thermoset process, whereby portion 25 is more resilient than portion 23. In one implementation, the thermoset material of portion 25 is selected so that portion 25 resists deflection beyond 7% in the range of anticipated uses of insert 21. Other materials are likewise suitable for either or both of portions 23, 25, including foam, plastic, thermoplastic elastomers, vulcanized or thermoset rubber, elastomeric materials, cellular materials, metal, wood, cellulose, paper, or still other non-foam or non-plastic materials, alone or in combination.

According to one alternative implementation, portions 23 and 25 are predominately formed of thermoset foam materials, with portion 25 being correspondingly more rigid, and formed into a dome shape, with a planar lower surface substantially coplanar with lower surface 31 of portion 23.

Whatever individual material or combinations of materials may be selected for given applications of the present disclosure, the resiliency and compression load deflection characteristics may be varied or tuned to the gait cycle of a particular wearer, average wearer, or class of wearers (for example, obese individuals, diabetics, men, women, children, and the like).

In the disclosed implementation, for example, upper surface 29 of portion 23, when in its unloaded state, is generally higher relative to upper surface 47 of portion 25. When device 21 is in use, and thus subject to weight of the wearer and forces of the gait cycle, the interplay of the differing resiliency or compression characteristics of the two portions 23, 25 may reduce pain and foster other therapeutic benefits as described herein. So, when a wearer is walking (or running, climbing, etc.), heel j either impacts the ground or is "pushing off" or propelling off the ground. During such gait phase or phases, the increased compressibility of portion 23 relative to portion 25 may result in upper surface 29 of portion 23 being compressed downwardly relative to the sole of the shoe, by the wearer's heel, such that it lies in a horizontal plane generally below at least apex region 49 of portion 25. Otherwise stated, during heel-strike phases of a person's gait cycle, the respective durometers of the first and second portions 23, 25 are selected to compress first portion 23 vertically more than second portion 25 to off-load heel-strike force toward the mid-foot. The relative compressibility (or its converse, rigidity) between portions 23, 25 is thus selected or tuned to "offload" force otherwise felt by the heel j toward mid-foot h.

The rates at which portions 23 and 25 compress relative to each other may also be tuned to correspond to the expected time heel j will be exposed to impact or propulsive force during the gait cycle. Otherwise stated, durometer selection for portions 23, 25 may factored into the timing of the wearer's gait cycle, either on average, by class, or for a particular person.

Portions 23, 25 are suitably secured to remain in position relative to each other, such as by suitably located adhesive effective for foam materials, by heat bonding or other fusing techniques, or by combining portions 23, 25 with integrating covers, tapes, or adhesive layers.

Still other materials are likewise suitable for implementing the features of this disclosure and the scope of this disclosure is not limited by those materials specifically mentioned above. It is likewise appreciated that material may be combined with other materials of varying compressibility and resiliency and that the durometer range may be tuned or otherwise varied to include different ranges for portions 23, 25 or more than just the two ranges discussed herein. Similarly, suitable fabric, edges, or coverings or materials may be either engineered into the materials disclosed herein or arranged so as to encapsulate or overlie portions 23, 25. Such additional features are likewise part of the present disclosure.

Furthermore, the durometer range of portions 23, 25 may be varied depending on the weight of the intended user. As such, it is possible that different durometer ranges may be appropriate for device 21 intended for obese individuals on the one hand, or those below average weight on the other. Similarly, different durometer ranges may be appropriate for devices 21 for men, women, or children. In some applications, the durometer of portion 23 may be selected to substantially equilibrate the heel of the intended wearer during walking, whereby device 21 assists in causing heel j to "float" during the heel strike and contact phases of a person's gait.

The size of orthotic insert device may be varied depending on the wearer's foot size, gender, and similar such factors. Arcuate surfaces, arches, depressions, and other shaped features and contouring may likewise be incorporated into device 21 described herein, without departing from the scope of coverage of this disclosure.

In one suitable implementation, insert 21 measures about 14.5 cm in length from the rearmost portion 57 of the proximal edge 24 to forward edge 45 of insert 21, with upper surface 29 of portion 23 extending about 6.3 cm of that length, and upper surface 47 of second portion 25 extending the balance of about 8.2 cm. Device 21 has an average width of about 7 cm. In addition to varying the dimensions of device 21 to accommodate different foot sizes, it will be appreciated that the overall outer dimensions of device 21 will be contoured and otherwise configured for insertion into a wearer's shoe, and so the overall length and width given herein may be varied depending on the amount of contouring appropriate for the intended application.

Portion 23 may have a thickness of about 1.5 cm at rear 57 of edge 24, with upper surface 29 of portion 23 sloping gradually relative to lower surface 31 so that the relative distance between upper and lower surfaces 29, 31 is about 1.2 to 1.3 cm when measured near apex 49. Arcuate surface 33, in this implementation, forms a boundary between portions 23, 25, extending over a linear distance of about 5 cm and having a radius of curvature of about 6.5 cm.

Portion 25 has a thickness of about 1.2 to 1.3 cm at apex region 49, tapering distally through a pair of arcuate regions 46 and 48 having respective radii of curvature of about 16 cm and 13 cm, respectively. Apex region 49 extends longitudinally over a distance of about 1 cm.

In the implementation discussed herein, orthotic insert 21 consists essentially of two zones of material. A first zone located and sized to underlie the fat pad of heel j and having a corresponding compression load of 400 to 1,000 psi, and a second zone, anterior to the first zone and located and sized to underlie mid-foot h, the second zone having a compression load deflection value which is higher than that of the first zone, selected, for example, from the range of 600 and 1,200 psi. In practical terms, this means that the second portion deflects less readily than the first portion under comparable force. In this way, insert 21, through a relatively simple construction, includes designs and features to offload vertical force experienced by heel j to mid-foot h during a person's gait. The first and second zones formed by portions 23, 25, respectively, have an opposing boundary along arcuate surface 33, as discussed previously, and the differing rigidities between portions 23, 25 thereby form a transition zone 61 between the two rigidities designed into portions 23, 25. As such, this transition zone has a corresponding compression load deflection between that of the zone underlying heel j and that associated with portion 25 at apex region 49. In some applications, transition zone 61 may improve wearer comfort while still permitting offloading of vertical force from heel j toward mid-foot h.

Having described the structures and features of insert 21, its use and advantages are readily apparent. A pair of inserts 21 is placed in a corresponding pair of shoes, lower surface 52 of device 21 being generally placed to oppose the shoe insole, and upper surface 51 positioned to underlie the heel and mid-foot of the wearer. During walking, especially during heel strike and contact phase of a person's gait, the disclosed insert not only decreases the force felt on the heel, but also offloads such force, rapidly transferring the force and corresponding weight to the middle part of the foot, especially during the impact or propulsive phases of the gait.

By offloading the heel and transferring the weight to the mid-foot, force becomes dissipated over a much larger plantar surface area, decreasing felt impact on the heel and shortening the time the force is affecting the foot.

Among the advantages of the foregoing, decreasing the felt impact and transferring forces to the larger surface area of the foot and mid-foot generally decreases or eliminates associated discomfort with a variety of disorders of the heel and hind-foot, such as those listed earlier in this disclosure.

While one or more particular implementations have been set out in this disclosure, it will be appreciated that various alternatives to the disclosed structure are likewise contemplated and within the scope of this disclosure. For example, although the illustrated implementation makes use of just two pieces, it will be appreciated that further portions of varying materials or durometer may likewise be included. While the forward edge of the device terminates proximal to metatarsal heads, there may be applications where a full insert may be suitable. It is also contemplated that instead of two separate portions, insert 21 may be formed from a single, integral piece formed of one or more materials with varying durometers, whether horizontally, vertically, laterally, or longitudinally, located at the zones and locations of the heel and mid-foot in accordance with this disclosure.

Still further variations are contemplated by the disclosure herein, which should be understood to extend to the boundaries of the appended claims and equivalents thereto.

What is claimed is:

1. An orthotic insert for footwear to be worn by a person, the insert comprising:

a first portion located and sized to underlie the calcaneus of the person's heel; and a second portion anterior to the first portion, the second portion located and sized to underlie the mid-foot and the sagittal plane arch of the mid-foot when the insert is positioned in footwear worn by the person;

the insert having medial and lateral edges and the first and second portions extending transversely between the medial and lateral edges;

wherein the first portion is composed of a first resiliently compressible material;

wherein the second portion is composed of a second resiliently compressible material;

wherein each of the first resiliently compressible material is characterized by a first predetermined durometer value and the second resiliently compressible material is characterized by a second predetermined durometer value, the durometer values being determined according to the 00 scale of ASTM D2240;

wherein the first durometer value is lower than the second durometer value;

wherein the first and second portions have a lower surfaces forming coplanar portions defining a lowermost plane of the insert;

wherein the first portion has a first upper surface, wherein the second portion has a second upper surface, the second upper surface including a sagittal arch surface defined therein and adapted to underlie the sagittal plane arch of the foot when the insert is positioned in footwear worn by the person, the sagittal arch surface extending from the lateral to the medial edges of the insert, the sagittal arch surface having an uncompressed height relative to the lowermost plane that is substantially the same at both the medial and lateral edges; wherein the boundary between the distal end of the first portion and the proximal end of the second portion is oriented to slope upwardly between the lower surface of the first portion and the upper surface of the second portion; and wherein, when the insert is positioned in footwear worn by the person, the second portion at the sagittal arch surface is adapted to compress by an amount that is no more than 7 percent of the uncompressed height of the sagittal arch surface.

2. The orthotic insert of claim 1 wherein the first portion extends distally to define a distal portion sized to extend laterally between the medial and lateral edges of the insert, the first portion extending distally between first and second locations relative to the person's foot when the insert is positioned in footwear worn by the person, the first location configured to underlie the insertion point of the proximal ends of the plantar fascia on the medial tubercle of the calcaneus, the second location configured to underlie the calcaneal cuboid joint, the distal portion terminating at the second location at a distal edge of the first portion, the distal edge configured to be positioned adjacent to the sagittal plane arch of the person's foot;

wherein the second portion has a posterior portion, the posterior portion opposing the distal portion of the first portion to define a transversely oriented boundary, the transversely oriented boundary extending transversely between the medial and lateral edges of the insert and extending distally at an angle between the upper and lower surfaces of the first and second portions, the angle commencing at the first location and terminating at the second location; and wherein, when the insert is positioned in footwear worn by the person, the angle commences at the first location of the first portion underlying the insertion point of the proximal ends of the plantar fascia in the medial tubercle and terminates at the distal edge to form a transition zone of durometer value between the durometer values of the first and second portions.

3. The insert of claim 1, wherein the first durometer value is lower than the second durometer value by an amount ranging from 10 to 30.

4. The orthotic insert of claim 1, wherein the first portion has a compression load deflection value that is less than the compression load deflection value of the second portion undergoing the same compression load deflection test.

5. The orthotic insert of claim 1, wherein the first portion has a compression load deflection value of between 400 to 1,000 lbs. per square inch; and wherein the second portion has a compression load deflection value of between 600-1,200 lbs. per square inch.

6. The orthotic insert of claim 1, wherein the resiliently compressible material of the first portion has a durometer in the range of 70-80, and the second portion has a durometer in the range of 90-100.

7. The orthotic insert of claim 1, wherein the first and second portions have been sized to correspond, respectively, to underlie the heel and mid-foot of a user selected from the group consisting of men, women and children;

wherein the insert has a length extending from a proximal edge extending to a forward edge, wherein the first upper surface underlying the heel and the corresponding first resiliently compressible material extends from the proximal edge distally between 40-45 percent of the length of the insert, and the second, upper surface of the corresponding second, resiliently compressible material extends 55-65 percent of the overall length of the insert.

8. The insert of claim 1, wherein the resiliently compressible material comprises at least one material selected from the group consisting of thermoset materials, foam, plastic, thermoplastic elastomers, volcanized or thermoset rubber, elastomeric materials, cellular materials, metal, wood, cellulose, and paper.

9. The insert of claim 1, wherein the lower durometer of the first portion is selected to cause the first portion to deflect more than the second portion at the sagittal arch surface, in response to comparable load, whereby, during heel-strike phases of a gait cycle of the person, the insert is configured to off-load vertical force from the heel toward the mid-foot.

10. The insert claim of 1, further comprising a covering overlying the first and second portions.

11. The insert claim of 10, wherein the covering comprises a fabric.

12. An orthotic insert for a person's foot, the foot having lateral and medial sides, the insert comprising:

resiliently compressible material sized and shaped to extend transversely between medial and lateral edges to underlie the medial and lateral sides of the person's foot, and extending longitudinally between rear and distal edges to underlie the person's heel and the person's midfoot;

wherein the resiliently compressible material consists of first and second portions, the second portion having a durometer value ranging between 10 and 30 higher than the durometer value of the first portion, according to the 00 scale of ASTM D2240;

the first portion having a corresponding heel area at a first location configured to underlie the calcaneus of the heel when the insert is within footwear worn by the person, the heel area extending distally to terminate at a forward end of the first portion;

wherein the forward end of the first portion extends between the lateral and medial edges of the insert and, when the insert is within footwear worn by the person, the forward end is located on the insert at a second location configured to underlie the person's foot between the insertion point of the plantar fascia and the sagittal plane arch of the person's foot;

wherein the second portion extends distally from the first portion to a third location adapted to underlie the mid-foot when the insert is within footwear worn by the person;

wherein the second portion has a proximal end opposing the forward end of the first portion to form a boundary between the first and second portions, the boundary extending between the lateral and medial edges, whereby the durometer of the resiliently compressible material of the first portion proximal to the boundary is less than the durometer of the resiliently compressible material of the second portion distal to the boundary;

wherein the proximal end of the second portion has a sagittal arch area defined therein, the sagittal arch area located on the insert to underlie the sagittal plane arch of the person's foot when the insert is within footwear being worn by the person; wherein the first and second portions have respective upper and lower surfaces, and wherein the boundary between the distal end of the first portion and the proximal end of the second portion is oriented to slope upwardly between the lower surface of the first portion and the upper surface of the second portion;

wherein, in response to the weight of the person when wearing footwear with the insert therein, the size, shape and higher durometer of the resiliently compressible material at the sagittal arch area are selected to induce greater supporting force on the sagittal plane arch of the person's foot when wearing footwear with the insert, relative to supporting force induced by the resiliently compressible material at the heel area, whereby the insert is configured to off-load vertical force from the person's heel toward the person's mid-foot.

13. The insert of claim 12, wherein the forward end of the first portion terminates in a forward edge at the upper surface, the forward edge opposing the sagittal arch area.

14. The insert of claim 12, further comprising a covering overlying the first and second portions.

15. The insert claim of 14, wherein the covering comprises a fabric.

16. An orthotic device for a person's foot, the foot having lateral and medial sides, the device associated with footwear to be worn by the person, the footwear having a sole for contacting a ground plane when worn by the person, the device comprising:

lateral and medial edges defining a width configured to underlie the lateral and medial sides of the person's foot when the device is within the footwear worn by the person;

a compressible heel portion having a corresponding heel area adapted to underlie the calcaneus of the heel, the heel portion extending transversely between the lateral and medial edges of the device, the heel portion having a length extending from a rear edge to a distal edge and a width extending transversely between the medial and lateral edges;

wherein the distal edge is located on the device to underlie a location between the calcaneal cuboid joint and the sagittal plane arch of the person's foot when the device is within footwear being worn by the person;

a compressible mid-foot portion configured to extend distally from the heel portion toward the mid-foot, the mid-foot portion having a midfoot area and a sagittal arch area defined within the midfoot area, the mid-foot area adapted to underlie the person's mid-foot, the sagittal arch area adapted to underlie the sagittal plane arch of the person's foot, the sagittal arch area extending transversely between the lateral and medial edges of the device, the sagittal arch area having a proximal edge opposing the distal edge of the heel portion; wherein the heel and mid-foot portions have respective upper and lower surfaces, and wherein the boundary between the distal edge of the heel portion and the proximal edge of the sagittal arch area of the mid-foot portion is oriented to slope upwardly between the lower surface of the heel portion and the upper surface of the mid-foot portion;

wherein the heel area is characterized by an uncompressed height relative to the ground plane of the footwear and at a location that would correspond to the location of the calcaneus when the device is within footwear worn by the person;

wherein the mid-foot portion is characterized by a maximum uncompressed height relative to the ground plane;

wherein the maximum uncompressed height of the mid-foot portion is located within the sagittal arch area; and wherein the uncompressed height of the heel area is greater than the maximum uncompressed height of the mid-foot portion.

17. The orthotic device of claim 16, wherein the heel area comprises a planar area when uncompressed, the planar area sized and located to underlie the fat pad of the heel when the device is within footwear worn by the person, the planar area, when uncompressed, sloping downwardly to the sagittal arch area when uncompressed.

18. The orthotic device of claim 16, wherein the device comprises an insert removably placeable within the footwear.

19. The orthotic device of claim 16, wherein the first and second portions include respective upper and lower surfaces defined to extend between lateral and medial sides of the device, the lower surfaces being substantially planar, the lower surfaces being coplanar with respect to each other; and wherein the first portion has a first transversely oriented, forward surface extending from the lower surface of the first portion, distally and upwardly between the medial and lateral edges to define a slope, the forward surface terminating at the upper surface to define the distal edge of the heel area; and wherein the second portion has a second transversely oriented surface opposing the first transversely oriented surface, from the lateral to the medial sides, extending from the lower surface of the second portion upwardly to the upper surface of the second portion.

20. The orthotic device of claim 16, wherein the sagittal arch area is defined within the mid-foot area to extend from the distal edge of the first portion by an amount ranging from 0.5 centimeters to 1.5 centimeters.

* * * * *